US005245836A

United States Patent [19]

Lorentzen et al.

[11] Patent Number: 5,245,836

[45] Date of Patent: Sep. 21, 1993

[54] METHOD AND DEVICE FOR HIGH SIDE PRESSURE REGULATION IN TRANSCRITICAL VAPOR COMPRESSION CYCLE

[75] Inventors: Gustav Lorentzen; Jostein Pettersen; Roar R. Bang, all of Trondheim, Norway

[73] Assignee: Sinvent AS, Trondheim, Norway

[21] Appl. No.: 728,902

[22] Filed: Jul. 2, 1991

Related U.S. Application Data

[63] Continuation-in-part of Ser. No. 571,630, Sep. 6, 1990.

[30] Foreign Application Priority Data

Jan. 9, 1989 [NO] Norway ..... 890076

[51] Int. Cl.[5] ..... F25B 1/00

[52] U.S. Cl. ..... 62/174; 62/503

[58] Field of Search ..... 62/503, 513, 174, 149

[56] References Cited

U.S. PATENT DOCUMENTS

| | | | |
|---|---|---|---|
| 1,408,453 | 3/1922 | Goosmann | 62/149 |
| 1,591,302 | 7/1926 | Franklin . | |
| 2,219,815 | 10/1940 | Jones | 257/9 |
| 2,482,171 | 12/1949 | Gygax | 62/513 |
| 2,617,265 | 12/1952 | Ruff | 62/503 |
| 2,778,607 | 1/1957 | Leoni | 257/24 |
| 2,901,894 | 9/1959 | Zearfoss, Jr. | 62/509 |
| 3,234,738 | 2/1966 | Cook | 60/59 |
| 3,365,905 | 1/1968 | Barbier | 62/196 |
| 3,400,555 | 9/1968 | Granryd | 62/198 |
| 3,413,815 | 12/1968 | Granryd . | |
| 3,513,663 | 5/1970 | Martin, Jr. et al. | 62/159 |
| 3,597,183 | 8/1971 | Murphy et al. | 62/114 |
| 3,638,446 | 2/1972 | Palmer . | |
| 3,858,407 | 1/1975 | Schumacher | 62/217 |
| 3,872,682 | 3/1975 | Shook | 62/114 |
| 4,019,679 | 4/1977 | Vogt et al. | 237/2 B |
| 4,205,532 | 6/1980 | Brenan | 62/115 |
| 4,439,996 | 4/1984 | Frohbreter | 62/174 |
| 4,631,926 | 12/1986 | Goldshtein | 62/115 |
| 4,679,403 | 7/1987 | Yoshida et al. | 62/114 |
| 4,702,086 | 10/1987 | Nunn, Sr. et al. | 62/113 |
| 5,042,262 | 8/1991 | Gyger et al. . | |

FOREIGN PATENT DOCUMENTS

| | | |
|---|---|---|
| 174027 | 3/1986 | European Pat. Off. . |
| 278095 | 6/1912 | Fed. Rep. of Germany . |
| 1021868 | 10/1958 | Fed. Rep. of Germany . |
| 2401120 | 7/1975 | Fed. Rep. of Germany . |
| 2604043 | 8/1976 | Fed. Rep. of Germany . |
| 2660122 | 5/1978 | Fed. Rep. of Germany . |
| 146882 | 9/1982 | Norway . |
| 463533 | 10/1988 | Sweden . |
| 1521998 | 11/1989 | U.S.S.R. . |
| 1042975 | 9/1966 | United Kingdom . |
| 90/07683 | 7/1990 | World Int. Prop. O. . |

OTHER PUBLICATIONS

*Refrigeration Engineering* by H. J. MacIntire pp. 60–61 John Wiley & Sons Inc. 1937.

Patent Abstracts of Japan, vol. 13, No. 489, M888, abstract of JP 01-193561, publ. 1989-08-03.

"Cooling Machinery and Apparatuses", Gntimash, Moscow 1946, p. 4, FIGS. 28–29.

"Principles of Refrigeration": by W. B. Gosney; Cambridge University Press, 1982.

Kalteprozesse Dargestellt Mit Hilfe Der Entropietofel, by Dipl-Ing. Prof. P. Ostertag, Berlin, Verlag Von Julius Springer, 1933 (w/translation).

Refrigeration Engineering, by H. J. MacIntire, 1937.

*Primary Examiner*—Albert J. Makay

*Assistant Examiner*—William C. Doerrler

*Attorney, Agent, or Firm*—Wenderoth, Lind & Ponack

[57] ABSTRACT

High side pressure in a transcritical vapor compression cycle system is regulated by varying a liquid inventory of a low pressure refrigerant receiver provided in a circuit of the system. The circuit includes a compressor, a gas cooler, a throttling valve, an evaporator and the receiver connected in series in a closed circuit operating at supercritical pressure in a high pressure side of the circuit. The degree of opening of the throttling valve is controlled to regulate the high side pressure in the circuit. It is possible to control capacity, and it also is possible to achieve minimum energy consumption for a given capacity requirement by regulating high side pressure.

26 Claims, 5 Drawing Sheets

METHOD AND DEVICE FOR HIGH SIDE PRESSURE REGULATION IN TRANSCRITICAL VAPOR COMPRESSION CYCLE

This is a continuation-in-part of U.S. application Ser. No. 571,630 filed Sep. 6, 1990 that corresponds to International Application No. PCT/NO. 89/00089, filed Apr. 30, 1990, now abandoned.

FIELD OF THE INVENTION

This invention relates to vapor compression cycle devices such as refrigerating, air-conditioning and heat pump systems, operating under transcritical conditions, i.e. operating with a refrigerant compressed to a supercritical pressure at a high pressure side of a compressor, and more particularly, to a method of high side pressure regulation maintaining optimum operation with respect to energy consumption.

BACKGROUND OF THE INVENTION

A conventional vapor compression cycle device for refrigeration, air-conditioning or heat pump purposes is shown in principle in FIG. 1. The device consists of a compressor 1, a condensing heat exchanger 2, a throttling valve 3 and an evaporating heat exchanger 4. These components are connected in a closed flow circuit, in which a refrigerant is circulated. The operating principle of a vapor compression cycle device is as follows: The pressure and temperature of the refrigerant vapor are increased by the compressor 1, before it enters the condenser 2 where it is cooled and condensed, giving off heat to a secondary coolant. The high-pressure liquid is then throttled to the evaporator pressure and temperature by means of the expansion valve 3. In the evaporator 4, the refrigerant boils and absorbs heat from its surroundings. The vapor at the evaporator outlet is drawn into the compressor, completing the cycle.

Conventional vapor compression cycle devices use refrigerants (as for instance R-12, CF operating entirely at subcritical pressures. A number of different substances or mixtures of substances may be used as a refrigerant. The choice of refrigerant is, among others, influenced by the condensation temperature, as the critical temperature of the fluid sets the upper limit for the condensation to occur. In order to maintain a reasonable efficiency, it is normally desirable to use a refrigerant with a critical temperature at least 20–30K above the condensation temperature. Near-critical temperatures are normally avoided in design and operation of conventional systems.

The present technology is treated in full detail in the literature, e.g. the Handbooks of American Society of Heating, Refrigerating and Air Conditioning Engineers Inc., Fundamentals 1989 and Refrigeration 1986.

The ozone-depleting effect of presently employed common refrigerants (halocarbons) has resulted in strong international action to reduce or prohibit the use of these fluids. Consequently there is an urgent need for finding alternatives to the present technology.

Control of the conventional vapor compression cycle device is achieved mainly by regulating the mass flow of refrigerant passing through the evaporator. This is done, e.g., by suction line throttling or bypassing the compressor. These methods involve more complicated flow circuit and components, a need for additional equipment and accessories, reduced part-load efficiency and other complications.

A common type of liquid regulation device is a thermostatic expansion valve which is controlled by the superheat at the evaporator outlet. Proper valve operation under varying operating conditions is achieved by using a considerable part of the evaporator to superheat the refrigerant, resulting in a low heat transfer coefficient.

Furthermore, heat rejection in the condenser of the conventional vapor compression cycle device takes place mainly at constant temperature. Therefore, thermodynamic losses occur due to large temperature differences when giving off heat to a secondary coolant with a large temperature increase, as in heat pump applications or when the available secondary coolant flow is small.

The operation of a vapor compression cycle device under transcritical conditions has been formerly practiced to some extent. Up to the time when the halocarbons took over, 40–50 years ago, $CO_2$ was commonly used as a refrigerant, notably in ship refrigeration systems for provisions and cargo. The systems were designed to operate normally at subcritical pressures, with evaporation and condensation. Occasionally, typically when a ship was passing tropical areas, the cooling sea water temperature could be too high to effect normal condensation, and the plant would operate with supercritical conditions on the high side. (Critical temperature for $CO_2$ 31° C.). In this situation it was practiced to increase the refrigerant charge on the high side to a point where the pressure at the compressor discharge was raised to 90–100 bar, in order to maintain the cooling capacity at a reasonable level. $CO_2$ refrigeration technology is described in older literature, e.g. P. Ostertag "Kalteprozesse", Springer 1933 or H. J. MacIntire "Refrigeration Engineering", Wiley 1937.

The usual practice in older $CO_2$-systems was to add the necessary extra charge from separate storage cylinders. A receiver installed after the condenser in the normal way will not be able to provide the functions intended by the present invention.

Another possibility is known from German Patent No. 278,095 (1912). This method involves two-stage compression with intercooling in the supercritical region. Compared to the standard system, this involves installation of an additional compressor or pump, and a heat exchanger.

The textbook "Principles of Refrigeration" of W. B. Gosney (Cambridge Univ. Press 1982) points at some of the peculiarities of near-critical pressure operation. It is suggested that increasing the refrigerant charge in the high-pressure side could be accomplished by temporarily shutting the expansion valve, so as to transfer some charge from the evaporator. But it is emphasized that this would leave the evaporator short of liquid, causing reduced capacity at the time when it is most wanted.

OBJECTS OF THE INVENTION

It is therefore an object of one aspect of the present invention to provide a new, improved, simple and effective method and means for regulating high side pressure in a transcritical vapor compression cycle device, avoiding the above shortcomings and disadvantages of the prior art.

Another object of the present invention is to provide a vapor compression cycle device avoiding use of CFC refrigerants, and at the same time offering the possibility to employ several attractive refrigerants with respect to safety, environmental hazards and price.

A further object according to another aspect of the present invention is to provide such a new method and means making possible capacity regulation by operation at mainly constant refrigerant mass flow rate and simple capacity modulation by valve operation.

Still another object of the present invention is to provide a cycle device rejecting heat at gliding temperature, reducing heat-exchange losses in applications where secondary coolant flow is small or when the secondary coolant is to be heated to a relatively high temperature.

It is a yet further object of the present invention to provide a new simple method and means for regulating the high side pressure in a transcritical vapor compression circuit to achieve minimum energy consumption and optimum operation of the system.

SUMMARY OF THE INVENTION

The above and other objects of the present invention are achieved by providing a method for regulating the high side pressure in a circuit operating normally at transcritical conditions (i.e. supercritical high side pressure, subcritical low side pressure) where the thermodynamic properties in the supercritical state are utilized to control the high side pressure to regulate the capacity or to achieve minimum energy consumption.

In one application of this aspect of the present invention, the specific enthalpy at the evaporator inlet is regulated by deliberate use of the pressure and/or temperature before throttling for capacity control. Capacity is controlled by varying the refrigerant enthalpy difference in the evaporator, by changing the specific enthalpy of the refrigerant before throttling. In the supercritical state this can be done by varying the pressure and temperature independently. In a preferred embodiment, this modulation of specific enthalpy is done by varying the pressure before throttling. The refrigerant is cooled down as far as it is feasible by means of the available cooling medium, and the pressure regulated to give the required enthalpy.

In accordance with another aspect of the invention a steering or regulating strategy is provided for the throttling valve in the transcritical vapor compression circuit based on application of predetermined values of optimal high side pressure corresponding to detected actual operating conditions of the circuit. In a preferred embodiment of this aspect of the invention, the detection of the operating conditions is done by measurement of a temperature at or near the gas cooler outlet, and the valve position is modulated to predetermined set-point pressure by an appropriate control system.

BRIEF DESCRIPTION OF THE DRAWINGS

The invention will now be described in more detail, with reference to the attached drawings, wherein.

DETAILED DESCRIPTION OF THE INVENTION

A transcritical vapor compression cycle device according to one aspect of the present invention includes a refrigerant, the critical temperature of which is between the temperature of the heat inlet and the mean temperature of heat submittal, and a closed working fluid circuit where the refrigerant is circulated. Suitable working fluids may be, by way of examples, ethylene ($C_2H_4$), diborane ($B_2H_6$), carbon dioxide ($CO_2$), ethane ($C_2H_6$) and nitrogen oxide ($N_2O$). The closed working fluid circuit includes a refrigerant flow loop with an integrated storage segment.

Figure 1:
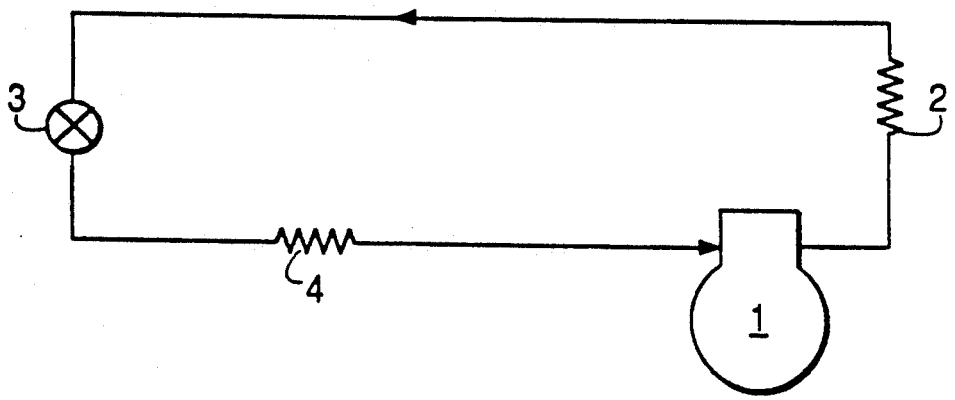
FIG. 1 PRIOR ART
FIG. 1 is a schematic representation of a conventional (subcritical) vapor compression cycle device.
Figure 2:
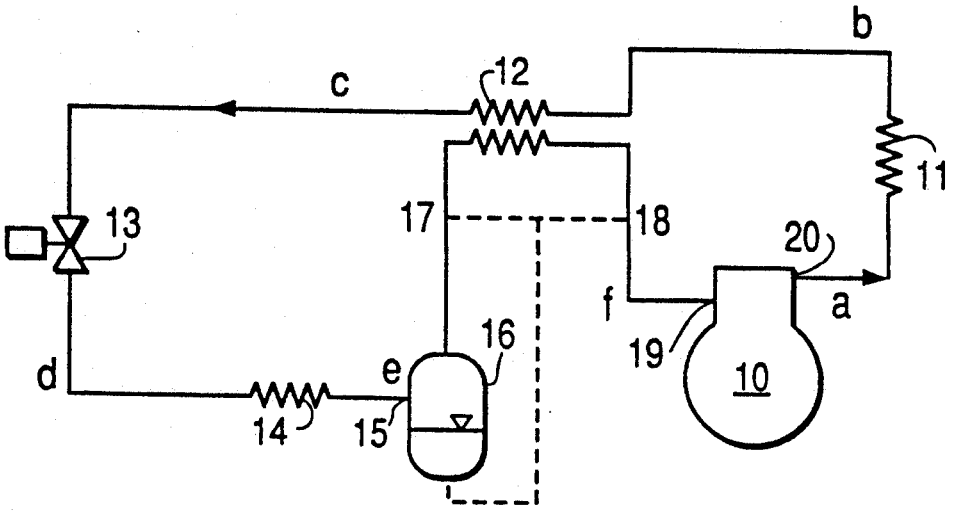
FIG. 2 is a schematic representation of a transcritical vapor compression cycle device constructed in accordance with one preferred embodiment of the invention. This embodiment includes a volume as an integral part of the low side pressure circuit, holding refrigerant in the liquid state.

FIG. 2 shows a preferred embodiment of this aspect of the invention where the storage segment is an integral part of the low side pressure circuit. The flow circuit includes a compressor 10 connected in series to a heat exchanger (gas coder) 11, a counterflow heat exchanger 12 and a throttling valve 13. An evaporating heat exchanger 14, a liquid separator/receiver 16 and the low pressure side of the counterflow heat exchanger 12 are connected in flow communication intermediate the throttling valve 13 and the inlet 19 of the compressor 10. The liquid receiver 16 is connected to the evaporator outlet 15, and the gas phase outlet of the receiver 16 is connected to the counterflow heat exchanger 12. The counterflow heat exchanger 12 is not absolutely necessary for the functioning of the device but improves its efficiency, in particular its rate of response to a capacity increase requirement. It also serves to return oil to the compressor. For this purpose a liquid phase line from the receiver 16 (shown by a broken line in FIG. 2) is connected to the suction line, either before the counterflow heat exchanger 12 at 17 or after it at 18, or anywhere between these points. The liquid flow, i.e. refrigerant and oil, is controlled by a suitable conventional liquid flow restricting device (not shown in the drawing). By allowing some excess liquid refrigerant to enter the vapor line, a liquid surplus at the evaporator outlet is obtained.

Figure 3:
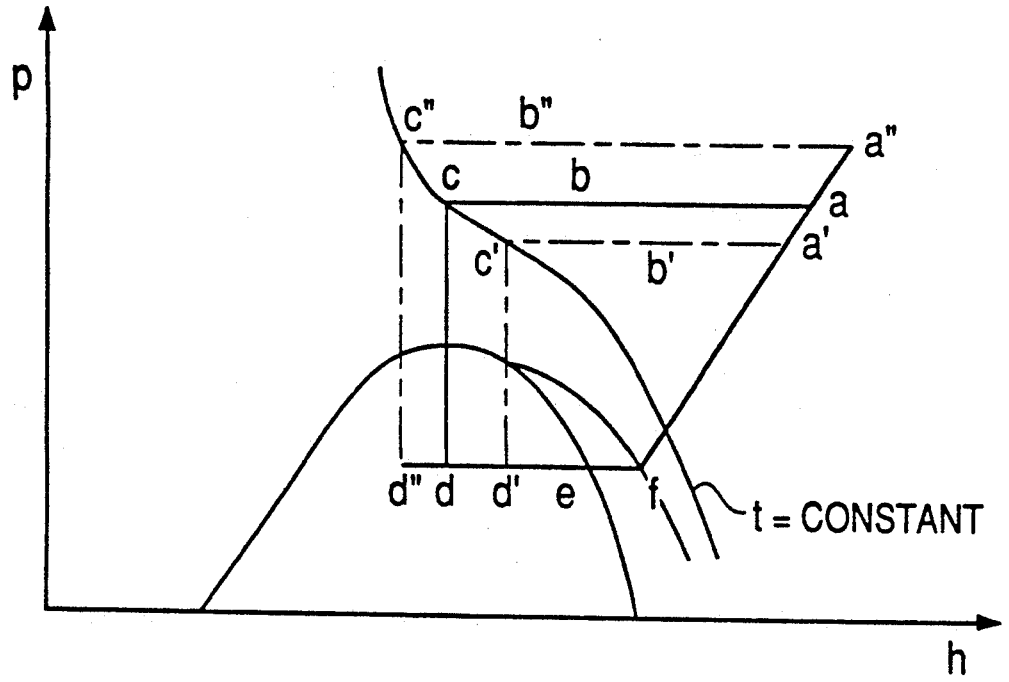
FIG. 3 is a graph illustrating the relationship of pressure versus enthalpy of the transcritical vapor compression cycle device of FIG. 2 and of FIG. 8 (discussed below) at different operating conditions.

In operation, the refrigerant is compressed to a suitable supercritical pressure in the compressor 10, the compressor outlet 20 is shown as state "a" in FIG. 3. The refrigerant is circulated through the heat exchanger 11 where it is cooled to state "b", giving off heat to a suitable cooling agent, e.g. cooling air or water. If desired, the refrigerant can be further cooled to state "c" in the counterflow heat exchanger 12, before being throttled to state "d". By the pressure reduction in the throttling valve 13, a two-phase gas/liquid mixture is formed, shown as state "d" in FIG. 3. The refrigerant absorbs heat in the evaporator 14 by evaporation of the liquid phase. From state "e" at the evaporator outlet, the refrigerant vapor can be superheated in the counterflow heat exchanger 12 to state "f" before it enters the compressor inlet 19, making the cycle complete. In the embodiment of the invention shown in FIG. 2, the evaporator outlet condition "e" will be in the two-phase region due to the liquid surplus at the evaporator outlet.

Modulation of capacity is accomplished by varying the refrigerant state at the evaporator inlet, i.e. point "d" in FIG. 3. The refrigerating capacity per unit of refrigerant mass flow corresponds to the enthalpy difference between state "d" and state "e". This enthalpy difference is found as a horizontal distance in the enthalpy-pressure diagram of FIG. 3. Throttling is a constant enthalpy process, and thus the enthalpy at point "d" is equal to the enthalpy at point "c". In consequence, the refrigerating capacity (in kW) at constant refrigerant mass flow can be controlled by varying the enthalpy at point "c".

It should be noted that in the transcritical cycle the high pressure single-phase refrigerant is not condensed but is reduced in temperature in the heat exchanger 11. The terminal temperature of the refrigerant in the heat exchanger (point "b") will be some degrees above the temperature of the entering cooling air or water, if counterflow heat exchange is used. The high pressure vapor can then be cooled a few degrees lower, to point "c" in the counterflow heat exchanger 12. The result is, however, that at constant cooling air or water inlet temperature, the temperature at point "c" will be mainly constant, independent of the pressure level in the high side. Therefore, modulation of device capacity is accomplished by varying the pressure in the high side, while the temperature at point "c" is mainly constant. The curvature of the isotherms near the critical point result in a variation of enthalpy with pressure, as shown in FIG. 3. This figure shows a reference cycle (a-b-c-d-e-f), a cycle with reduced capacity due to reduced high side pressure (a'-b'-c'-d'-e-f) and a cycle with increased capacity due to higher high side pressure (a''-b''-c''-d''-e-f). The evaporator pressure is assumed to be constant.

The pressure in the high-pressure side is independent of temperature, because it is filled with a single phase fluid. To vary the pressure it is necessary to vary the mass of refrigerant in the high side, i.e. to add or remove some of the instant refrigerant charge in the high side. These variations must be taken up by a buffer, to avoid liquid overflow or drying up of the evaporator.

In the preferred embodiment of the invention indicated in FIG. 2, the refrigerant mass in the high side can be increased by temporarily reducing the opening of the throttling valve 13. Due to the incidentally reduced refrigerant flow to the evaporator, the excess liquid fraction at the evaporator outlet 15 will be reduced. The liquid refrigerant flow from the receiver 16 into the suction line is however constant. Consequently, the balance between the liquid flow entering and leaving the receiver 16 is shifted, resulting in a net reduction in receiver liquid content and a corresponding accumulation of refrigerant in the high pressure side of the flow circuit. The increase in high side charge involves increasing high side pressure and thereby higher refrigerating capacity. This mass transfer from the low-pressure to the high-pressure side of the circuit will continue until a balance between refrigerating capacity and load is found.

Opening of the throttling valve 13 will increase the excess liquid fraction at the evaporator outlet 15, because the evaporated amount of refrigerant is mainly constant. The difference between this liquid flow entering the receiver and the liquid flow from the receiver into the suction line will accumulate. The result is a net transport of refrigerant charge from the high side to the low side of the flow circuit, with the reduction in the high side charge stored in liquid state in the receiver. By reducing the high side charge and thereby pressure, the capacity of the device is reduced, until a balance is found.

Some liquid transported from the receiver into the compressor suction line is also needed to avoid lubricant accumulation in the liquid phase of the receiver.

The embodiment of the invention indicated in FIG. 2 has the advantage of simplicity, with capacity control by operation of one valve only. Furthermore, the transcritical vapor compression cycle device built according to this embodiment has a certain self-regulating capability by adapting to changes in cooling load through change in liquid content in the receiver 16, involving changes in high side charge and thus cooling capacity. In addition, the operation with a liquid surplus at the evaporator outlet gives favorable heat transfer characteristics.

A well known peculiarity of transcritical cycles (operating with a supercritical pressure in the high pressure side of the circuit) is that the coefficient of performance COP, defined as the ratio between the refrigerating capacity and applied compressor shaft power, can be raised by increasing the high side pressure, while the gas cooler outlet refrigerant temperature is maintained mainly constant. This can be illustrated by means of the pressure enthalpy diagram of FIG. 3. However, the COP increases with increasing high side pressure only up to a certain level and then begins to decline as the extra refrigerating effect no longer fully compensates for the extra work of compression.

Figure 6:
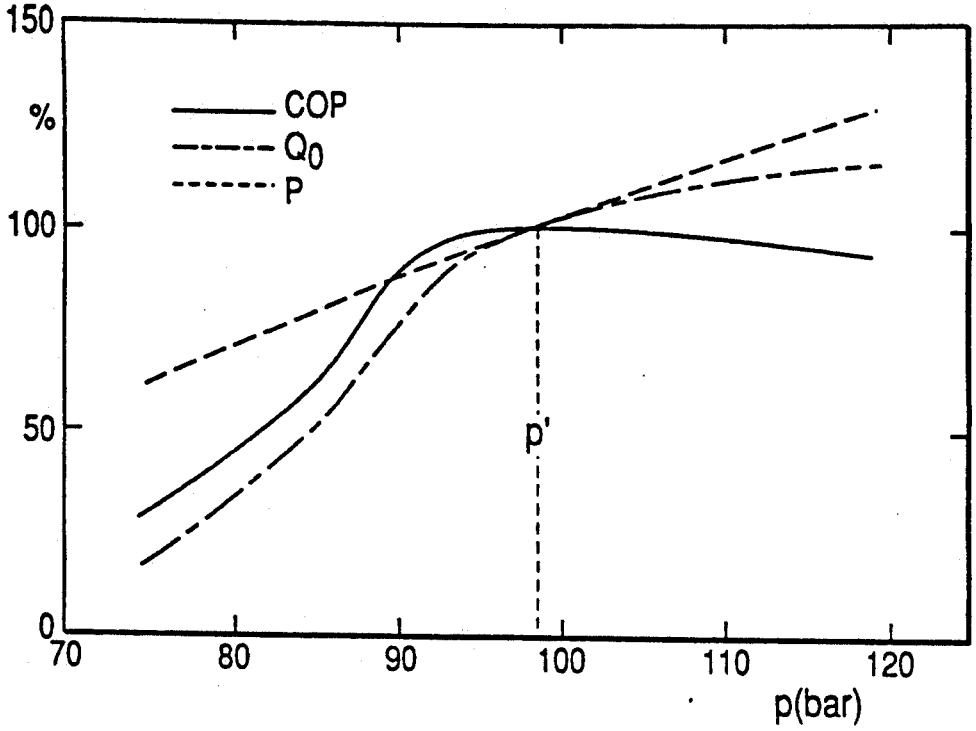
FIG. 6 is a graph illustrating the theoretical relationship between cooling capacity ($Q_o$), compressor shaft power (P) and their ratio (COP) in a transcritical vapor compression cycle at varying high side pressures, at constant evaporating temperature and gas cooler outlet refrigerant temperature.

Thus, for each set of actual operating conditions defined for instance by evaporating temperature and refrigerant temperature at the gas cooler outlet, a diagram showing the cooling capacity ($Q_o$), compressor shaft power (P) and their ratio (COP) as a function of high side pressure can be provided. FIG. 6 illustrates such a diagram generated for refrigerant $CO_2$ at constant evaporating and gas cooler outlet temperatures, based on theoretical cycle calculations. At a certain high side pressure corresponding to p' in FIG. 6, the COP reaches a maximum as indicated.

Figure 7:
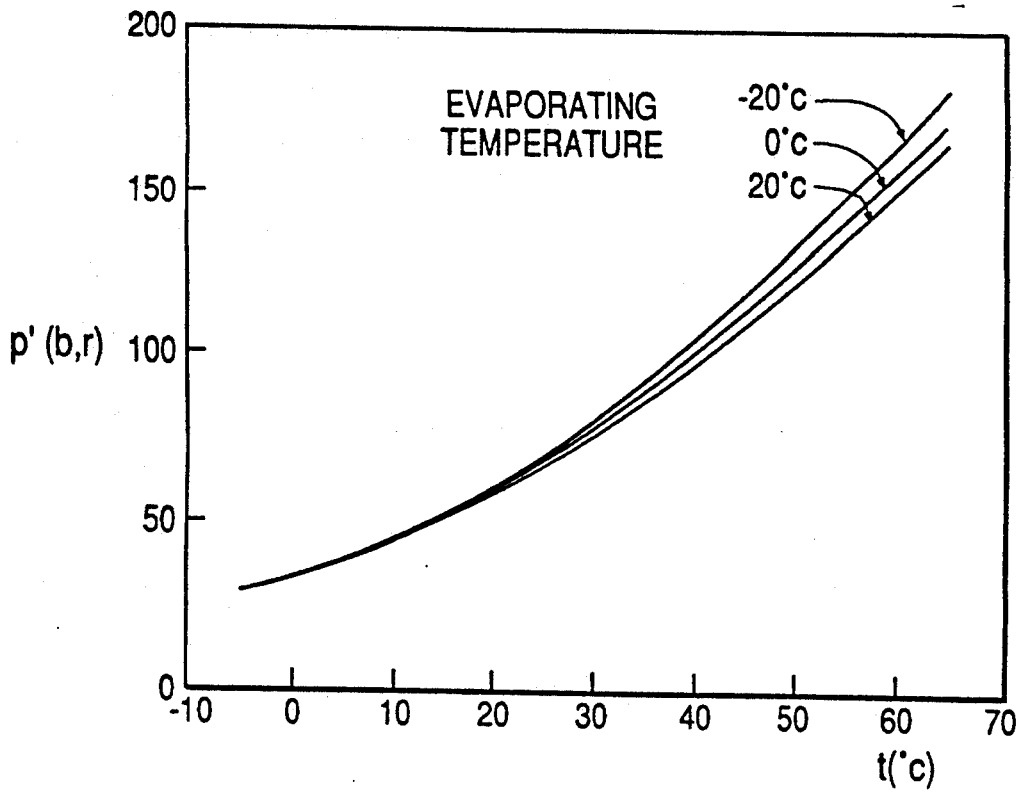
FIG. 7 is a graphic illustration of the theoretical relationship between optimum high side pressure, providing maximum ratio between cooling capacity and shaft power, and gas cooler outlet refrigerant temperature at three different evaporating temperatures.

By combining such results, i.e. corresponding data for gas cooler outlet refrigerant temperature, evaporating temperature and high side pressure providing maximum COP (p'), at varying operating conditions, a new set of data, as shown in FIG. 7 is provided, which may be applied in the throttling valve steering or regulating strategy. By regulating the high side pressure in accordance with this diagram a maximum ratio between refrigerating capacity and compressor shaft power will always be maintained.

Under maximum load conditions it still may be expedient to operate the system at a discharge pressure well above the level corresponding to maximum COP for a shorter period of time, to limit the compressor volume required and thereby the capital cost and overall energy consumption. At low load conditions, however, a combination of reduced high side pressure to a predetermined optimum level and capacity regulation conducted by a separate control system will provide minimum energy consumption.

Since varying evaporating temperature has a noticeable effect only at high gas cooler outlet refrigerant temperature, this influence may be neglected in practice. Thus, the detected refrigerant temperature at the gas cooler outlet or some other temperature or parameter corresponding thereto (e.g. cooling water inlet temperature, ambient air temperature, cooling or heating load) will be the only significant steering or regulating parameter required as input for control of the throttling valve.

The use of a back pressure controller as a throttling valve may give certain advantages in that internal compensation for varying refrigerant mass flow and density is obtained. A throttling valve with back-pressure control will keep the inlet pressure, i.e. high side pressure, at a particular set point, regardless of refrigerant mass flow and inlet refrigerant temperature. The set point of the back-pressure controller is then regulated by means of an actuator operating in accordance with the predetermined control scheme indicated above.

Transcritical vapor compression cycle devices built according to the invention can be applied in several areas. The technology is well suitable in small and medium-sized stationary and mobile air-conditioning units, small and medium-sized refrigerators/freezers and in smaller heat pump units. One of the most promising applications is in automotive air-conditioning, where the present need for a new, non-CFC, lightweight and efficient alternative to R12-systems is urgent.

The practical use of the above embodiment of the present invention for refrigeration or heat pump purposes is illustrated by the following examples, giving test results from a transcritical vapor compression cycle device built according to the embodiment of the invention shown in FIG. 2, employing carbon dioxide ($CO_2$) as refrigerant. A laboratory test device used water as a heat source, i.e. the water was refrigerated by heat exchange with boiling $CO_2$ in the evaporator 14. Water also was used as a cooling agent, being heated by $CO_2$ in the heat exchanger 11. The test device included a 61 ccm reciprocating compressor 10 and a receiver 16 with a total volume of 4 liters. The system also included a counterflow heat exchanger 12 and liquid line connection from the receiver to point 17, as indicated in FIG. 2. The throttling valve 13 was operated manually.

EXAMPLE 1

This example shows how control of refrigerating capacity was obtained by varying the position of the throttling valve 13, thereby varying the pressure in the high side of the flow circuit. By variation of high side pressure, the specific refrigerant enthalpy at the evaporator inlet was controlled, resulting in modulation of refrigerating capacity at constant mass flow. The water inlet temperature to the evaporator 14 was kept constant at 20° C., and the water inlet temperature to the heat exchanger 11 was kept constant at 35° C. Water circulation was constant both in the evaporator 14 and the heat exchanger 11. The compressor ran at constant speed.

Figure 4:
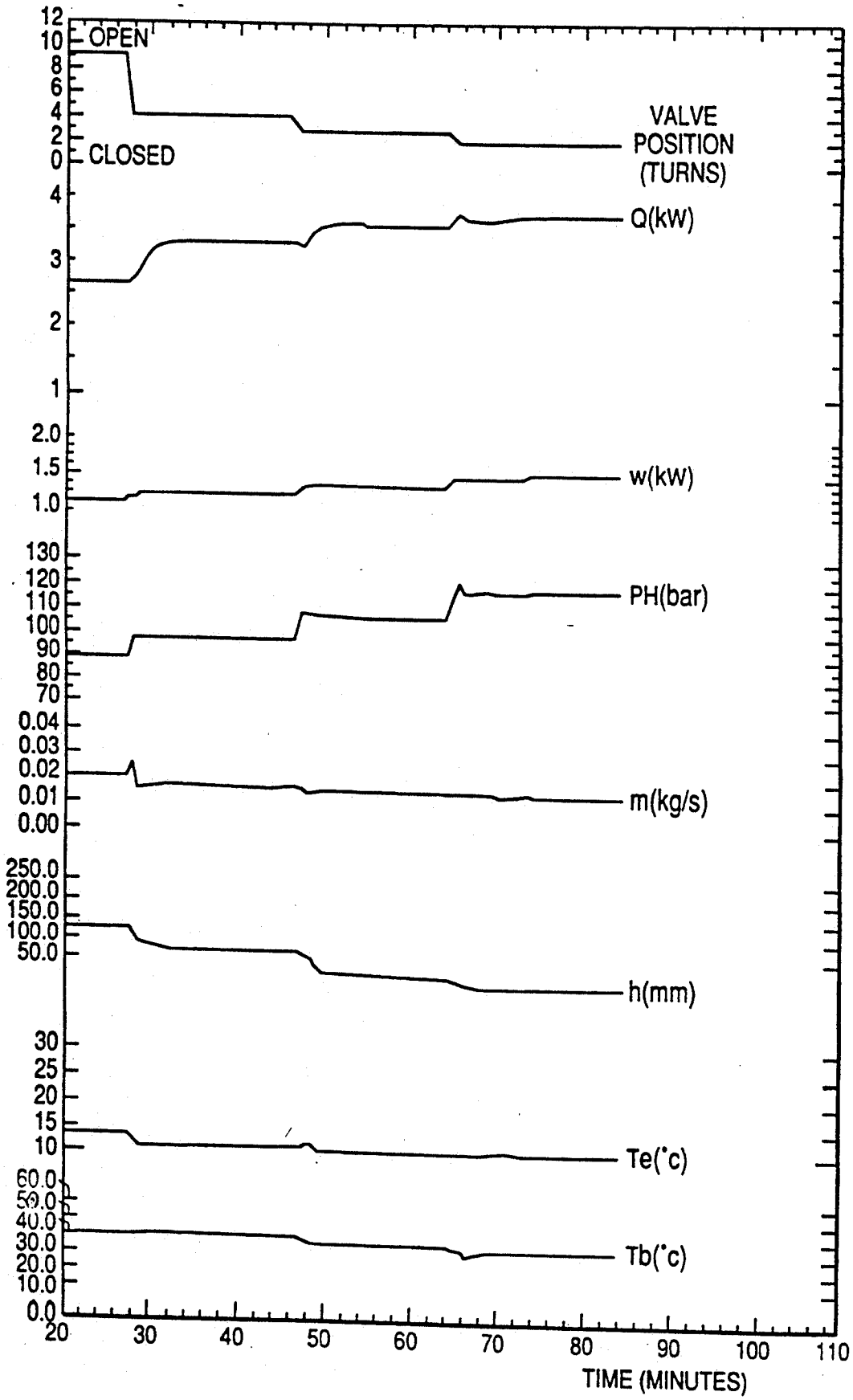
FIG. 4 is a collection of graphs illustrating the control of refrigerating capacity by the method of pressure control in accordance with the present invention. The results shown are measured in a laboratory demonstration system built according to a preferred embodiment of the invention.

FIG. 4 shows the variation of refrigerating capacity (Q), compressor shaft work (W), high side pressure ($p_h$), $CO_2$ mass flow (m), $CO_2$ temperature at evaporator outlet ($T_e$), $CO_2$ temperature at the outlet of heat exchanger 11 ($T_b$) and liquid level in the receiver (h) when the throttling valve 13 is operated as indicated at the top of the figure. The adjustment of throttling valve position is the only manipulation. As shown in FIG. 4, capacity (Q) is easily controlled by operating the throttling valve (13). It is further clear that at stable conditions, the circulating mass flow of $CO_2$ (m) is mainly constant and independent of the cooling capacity. The $CO_2$ temperature at the outlet of heat exchanger 11 ($T_b$) is also mainly constant. The graphs show that the variation of capacity is a result of varying high side pressure ($p_H$) only. It can also be seen that increased high side pressure involves a reduction in the receiver liquid level (h), due to the $CO_2$ charge transfer to the high pressure side of the circuit. Finally, it can be noted that the transient period during capacity increase does not involve any significant superheating at the evaporator outlet, i.e. only small fluctuations in $T_e$.

EXAMPLE 2

With higher water inlet temperature to heat exchanger 11 (e.g. higher ambient temperature), it is necessary to increase the high side pressure to maintain a constant refrigerating capacity. Table 1 shows results from tests run at different water inlet temperatures to heat exchanger 11 ($t_w$). The water inlet temperature to the evaporator was kept constant at 20° C., and the compressor ran at constant speed. As Table 1 shows, the cooling capacity can be kept mainly constant when the ambient temperature rises, by increasing the high side pressure. The refrigerant mass flow is mainly constant, as shown. Increased high side pressures involve a reduction in receiver liquid content, as indicated by the liquid level readings.

TABLE 1

| | | | | |
|---|---|---|---|---|
| Inlet temperature ($t_w$) | 35.1 | 45.9 | 57.3 | °C. |
| Refrigerating capacity (Q) | 2.4 | 2.2 | 2.2 | kW |
| High side pressure ($p_H$) | 84.9 | 94.3 | 114.1 | bar |
| Mass flow (m) | 0.026 | 0.024 | 0.020 | kg/s |
| Liquid level (h) | 171 | 166 | 115 | mm |

EXAMPLE 3

Figure 5:
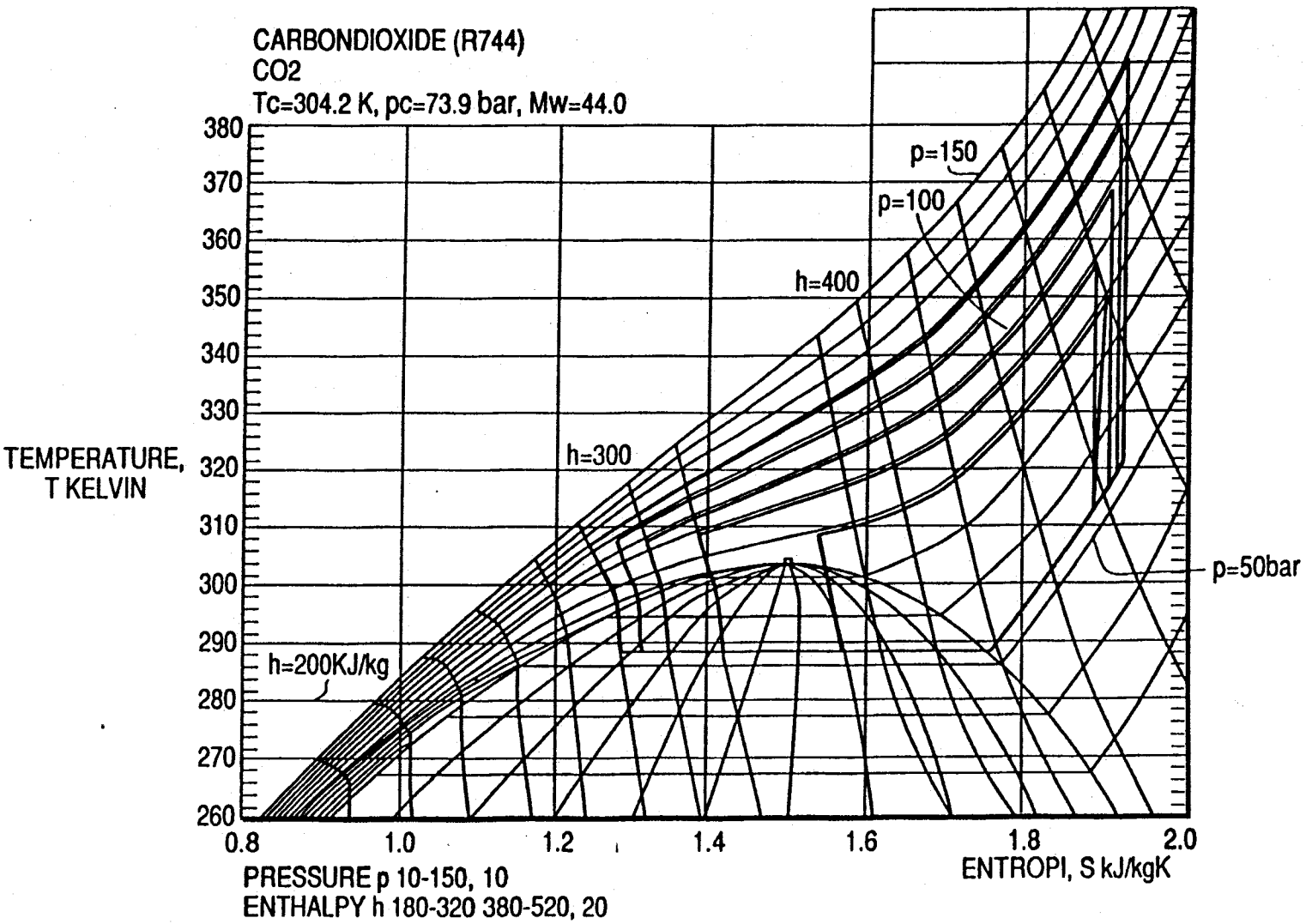
FIG. 5 is a graph of test results showing the relationship of temperature versus entropy of the transcritical vapor compression cycle device of FIG. 2, operating at different high side pressures, employing carbon dioxide as a refrigerant.

FIG. 5 is a graphic representation of transcritical cycles in the entropy/temperature diagram. The cycles shown are based on measurements on the laboratory test device during operation at five different high side pressures. The evaporator pressure was kept constant, and the refrigerant was $CO_2$. FIG. 5 provides a good indication of the capacity control principle, indicating changes in specific enthalpy (h) at evaporator inlet caused by variation of the high side pressure (p).

EXAMPLE 4

Figure 8:
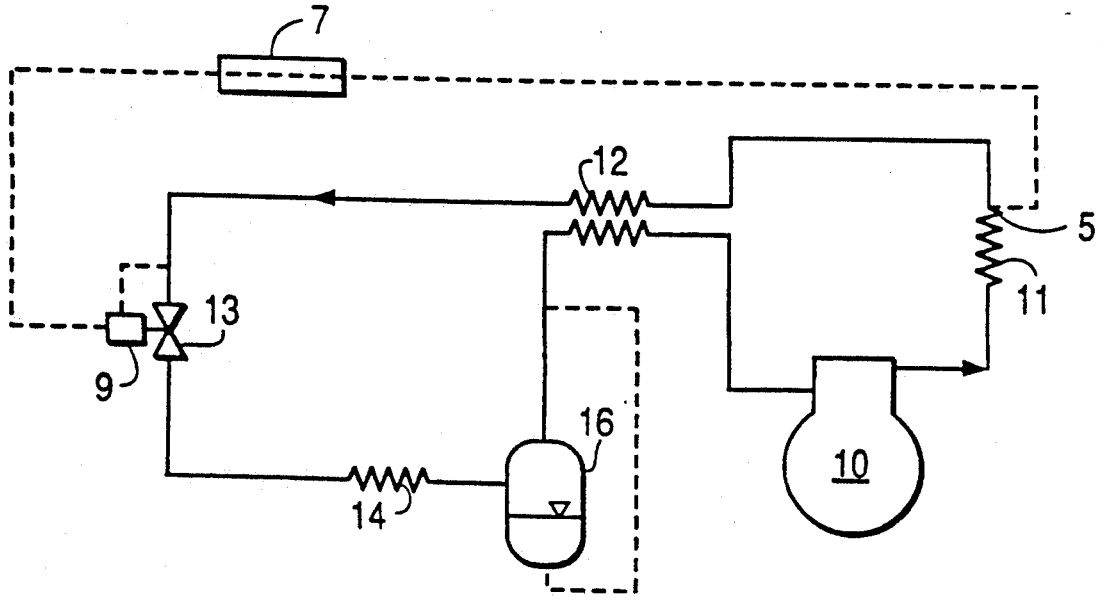
FIG. 8 is a schematic representation similar to FIG. 2 but of a transcritical vapor compression cycle device constructed in accordance with another preferred embodiment of the invention.

FIG. 8 is similar to FIG. 2 and illustrates a preferred embodiment of the transcritical refrigerating circuit according to this aspect of the invention and comprising a compressor 10 connected in series to a gas cooler 11, an internal counterflow heat exchanger 12 and a throttling valve 13. An evaporator 14 and a low pressure liquid receiver 16 are connected intermediate the throttling valve and the compressor. A temperature sensor at the gas cooler refrigerant outlet 5 provides information on the operating conditions of the circuit to a control system 7, e.g. a microprocessor. The throttling valve 13 is equipped with an actuator 9, and the valve position is automatically modulated in accordance with the predetermined set-point pressure characteristics by the control system 7.

EXAMPLE 5

With reference to FIG. 8, the circuit may be provided with a throttling valve 13 based on a simple mechanical back-pressure controller eliminating use of the microprocessor and electronic control of the valve shown in Example 1. The regulator may be equipped with a temperature sensor bulb situated at or near the gas cooler refrigerant outlet 5. Through a membrane arrangement, the pressure resulting from the sensor bulb temperature mechanically adjusts the set-point of the back-pressure controller according to the gas cooler outlet refrigerant temperature. By adjusting spring forces and charge in the sensor, an appropriate relation between the temperature and pressure in the actual regulation range may be obtained.

EXAMPLE 6

The circuit is based on one of the throttling valve control concepts described in Examples 4 or 5, but instead of locating the temperature sensor or sensor bulb at the gas cooler refrigerant outlet, the sensor or sensor bulb measures the inlet temperature of the cooling agent to which heat is rejected. By counterflow heat exchange, there is a relation between gas cooler refrigerant outlet and cooling medium inlet temperatures, as the refrigerant outlet temperature closely follows the cooling medium inlet temperature. The applied cooling medium is normally ambient air or cooling water.

While the invention has been illustrated and described in the drawings and foregoing description in terms of preferred embodiments it is apparent that changes and modifications may be made therein without departing from the spirit or scope of the invention as set forth in the appended claims. Thus, e.g. in any of the concepts described in Examples 4 or 5 the signal from a temperature sensor or bulb may be replaced by a signal representing the desired cooling or heating capacity of the system. Due to the correspondence between ambient temperature and load, this signal may serve as a basis for regulating the throttling valve set-point pressure.

We claim:

1. In a method of operation of a transcritical vapor compression cycle system, said method comprising circulating a refrigerant through a closed circuit by compressing said refrigerant in a compressor to a supercritical pressure, cooling the thus pressurized refrigerant in a cooler, reducing the pressure of said refrigerant by throttling, and evaporating said refrigerant at said reduced pressure in an evaporator, the improvement comprising:

regulating said supercritical pressure of said refrigerant in a high pressure side of said closed circuit by varying the refrigerant mass in said high pressure side by varying the mass of refrigerant in a buffer receiver in said closed circuit, wherein increasing of said pressure is achieved by decreasing said refrigerant mass in said receiver and wherein decreasing of said pressure is achieved by increasing said refrigerant mass in said receiver.

2. The improvement claimed in claim 1, comprising modulating refrigerating capacity by said regulating said high side pressure.

3. The improvement claimed in claim 1, comprising minimizing energy consumption in said system at given refrigerating capacity requirements thereof by said regulating said high side pressure.

4. The improvement claimed in claim 1, comprising providing said buffer receiver in a low pressure side of said closed circuit.

5. The improvement claimed in claim 4, comprising providing said buffer receiver between said evaporator and said compressor.

6. The improvement claimed in claim 1, wherein said regulating comprises controlling a degree of said throttling.

7. The improvement claimed in claim 6, wherein said regulating is achieved solely by controlling said relative degree of throttling.

8. The improvement claimed in claim 6, comprising detecting at least one operating condition of said circuit, and controlling said degree of throttling as a function of said detected operating condition.

9. The improvement claimed in claim 8, wherein said degree of throttling is controlled as a function of said detected operating condition in accordance with a predetermined set of high pressure values to achieve minimum energy consumption at given refrigerating capacity requirements.

10. The improvement claimed in claim 8, wherein said operating condition comprises refrigerant temperature adjacent an outlet of said cooler.

11. The improvement claimed in claim 1, comprising maintaining carbon dioxide in said circuit as said refrigerant.

12. The improvement claimed in claim 1, further comprising passing in heat exchange relationship low pressure refrigerant from an outlet of said evaporator and high pressure refrigerant from an outlet of said cooler, thereby cooling said high pressure refrigerant and superheating said low pressure refrigerant.

13. The improvement claimed in claim 1, comprising circulating refrigerant flow into and from said buffer receiver.

14. In a transcritical vapor compression cycle system comprising a closed circuit circulating therethrough a refrigerant and including a compressor compressing the refrigerant to a supercritical pressure, a cooler cooling the thus pressurized refrigerant, throttling means reducing the pressure of said refrigerant, and an evaporator evaporating said refrigerant at said reduced pressure, the improvement comprising:

means for regulating said supercritical pressure of said refrigerant in a high pressure side of said closed circuit by varying the refrigerant mass in said high pressure side by varying the mass of refrigerant in a buffer receiver in said closed circuit, wherein increasing of said pressure is achieved by decreasing said refrigerant mass in said receiver and wherein decreasing of said pressure is achieved by increasing said refrigerant mass in said receiver.

15. The improvement claimed in claim 14, wherein operation of said regulating means modulates refrigerating capacity of said system.

16. The improvement claimed in claim 14, wherein operation of said regulating means minimizes energy consumption in said system at given refrigerating capacity requirements thereof.

17. The improvement claimed in claim 14, wherein said buffer receiver is provided in a low pressure side of said closed circuit.

18. The improvement claimed in claim 17, wherein said buffer receiver is located between said evaporator and said compressor.

19. The improvement claimed in claim 14, wherein said regulating means comprises means for controlling a degree of opening of said throttling means.

20. The improvement claimed in claim 19, wherein said regulating means is formed solely by said controlling means.

21. The improvement claimed in claim 19, further comprising means for detecting at least one operating condition of said circuit and for operating said controlling means as a function of said detected operation condition.

22. The improvement claimed in claim 21, wherein said detecting means operates said controlling means as a function of said detected operating condition in accordance with a predetermined set of high pressure values to achieve minimum energy consumption at given refrigerating capacity requirements.

23. The improvement claimed in claim 21, wherein said detecting means comprises means for determining refrigerant temperature adjacent an outlet of said cooler.

24. The improvement claimed in claim 14, wherein said refrigerant comprises carbon dioxide.

25. The improvement claimed in claim 14, further comprising means for passing in heat exchange relationship low pressure refrigerant from an outlet of said evaporator and high pressure refrigerant from an outlet of said cooler, thereby cooling said high pressure refrigerant and superheating said low pressure refrigerant.

26. The improvement claimed in claim 14, wherein said buffer receiver includes means for circulating refrigerant flow thereinto and therefrom.

* * * * *